US008439457B2

(12) United States Patent
Lin

(10) Patent No.: US 8,439,457 B2
(45) Date of Patent: May 14, 2013

(54) ADJUSTABLE DRESSING MIRROR ASSEMBLY

(76) Inventor: Chen-Chieh Lin, Taichung (TW)

( * ) Notice: Subject to any disclaimer, the term of this patent is extended or adjusted under 35 U.S.C. 154(b) by 90 days.

(21) Appl. No.: 13/221,813

(22) Filed: Aug. 30, 2011

(65) Prior Publication Data

US 2013/0050863 A1 Feb. 28, 2013

(51) Int. Cl.
*A47G 1/00* (2006.01)
*A47B 67/00* (2006.01)

(52) U.S. Cl.
USPC ..... 312/226; 248/474

(58) Field of Classification Search ..... 312/224–226; 248/456, 466, 469, 474; 359/840, 872
See application file for complete search history.

(56) References Cited

U.S. PATENT DOCUMENTS 1,390,938 A * 9/1921 Thompson ..... 248/456
1,836,053 A * 12/1931 Wagner ..... 248/456
2,623,435 A * 12/1952 Geis ..... 108/3
2,877,687 A * 3/1959 Bozin ..... 248/477
2,943,536 A * 7/1960 Stafford ..... 248/479
2,984,440 A * 5/1961 Simons ..... 248/477
3,003,397 A * 10/1961 Jacobus ..... 359/875
3,774,247 A * 11/1973 Bradley ..... 5/53.2
4,116,413 A * 9/1978 Andersen ..... 248/451
4,295,624 A * 10/1981 Granada ..... 248/456
4,482,185 A * 11/1984 Zoellner ..... 297/135
4,602,855 A * 7/1986 Frey ..... 359/875
4,669,694 A * 6/1987 Malick ..... 248/397
4,693,444 A * 9/1987 Williams et al. ..... 248/653
5,082,230 A * 1/1992 Chang ..... 248/476
D329,753 S * 9/1992 Delafield ..... D6/311
5,292,118 A * 3/1994 Allen et al. ..... 473/484
5,681,100 A * 10/1997 Powell ..... 312/227
D387,920 S * 12/1997 Powell ..... D6/397
7,523,907 B2 * 4/2009 Chen ..... 248/292.12
8,220,880 B1 * 7/2012 Lin ..... 312/227

* cited by examiner

*Primary Examiner* — Mark Consilvio
(74) *Attorney, Agent, or Firm* — Ladas & Parry, LLP

(57) ABSTRACT

An adjustable dressing mirror assembly includes a support, a mirror-mounting unit, and a positioning device. The positioning device includes a guiding seat connected pivotally to the support, a driving plate connected pivotally to the mirror-mounting unit, a sliding block, a movable member, a positioning rod, and a resilient member. The guiding seat includes an accommodating chamber and a plurality of positioning grooves. The driving plate and the sliding block are movable in the accommodating chamber. The positioning rod is disposed fixedly on the movable member. Engagement between the positioning rod and the positioning grooves is allowed with assistance of the resilient member during movement of the driving plate within the accommodating chamber from a rear limit position to a front limit position, and is prevented during movement of the driving plate within the accommodating chamber from the front limit position to the rear limit position.

6 Claims, 15 Drawing Sheets

ADJUSTABLE DRESSING MIRROR ASSEMBLY

BACKGROUND OF THE INVENTION

1. Field of the Invention

This invention relates to a mirror, and more particularly to an adjustable dressing mirror assembly.

2. Description of the Related Art

Referring to FIG. 1, a conventional adjustable dressing mirror assembly 10 includes a support 11, a mirror frame 13 disposed pivotally on the support 11 by two pivot members 12, and a mirror 14 disposed fixedly within the mirror frame 13.

The mirror frame 13 is rotatable about the pivot members 12 to adjust the inclination angle of the mirror 14. However, when the mirror 14 is adjusted to a desired angle, the desired angle cannot be maintained. For example, when an external force is applied accidentally to the mirror frame 13, the inclination angle of the mirror 14 may be changed, thereby requiring readjustment to result in inconvenience during use of the dressing mirror assembly 10.

SUMMARY OF THE INVENTION

The object of this invention is to provide a dressing mirror assembly that includes a mirror adjustable to a desired angle and capable of being maintained at the desired angle.

Accordingly, an adjustable dressing mirror assembly of this invention includes a support, a mirror-mounting unit, and a positioning device. The positioning device includes a guiding seat connected pivotally to the support, a driving plate connected pivotally to the mirror-mounting unit, a sliding block, a movable member, a positioning rod, and a resilient member. The guiding seat includes an accommodating chamber and a plurality of positioning grooves. The driving plate and the sliding block are movable in the accommodating chamber. The positioning rod is disposed fixedly on the movable member. Engagement between the positioning rod and the positioning grooves is allowed with assistance of the resilient member during movement of the driving plate within the accommodating chamber from a rear limit position to a front limit position, and is prevented during movement of the driving plate within the accommodating chamber from the front limit position to the rear limit position. Through engagement between the positioning rod and the positioning grooves, the mirror-mounting unit can be maintained at a desired inclination angle.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
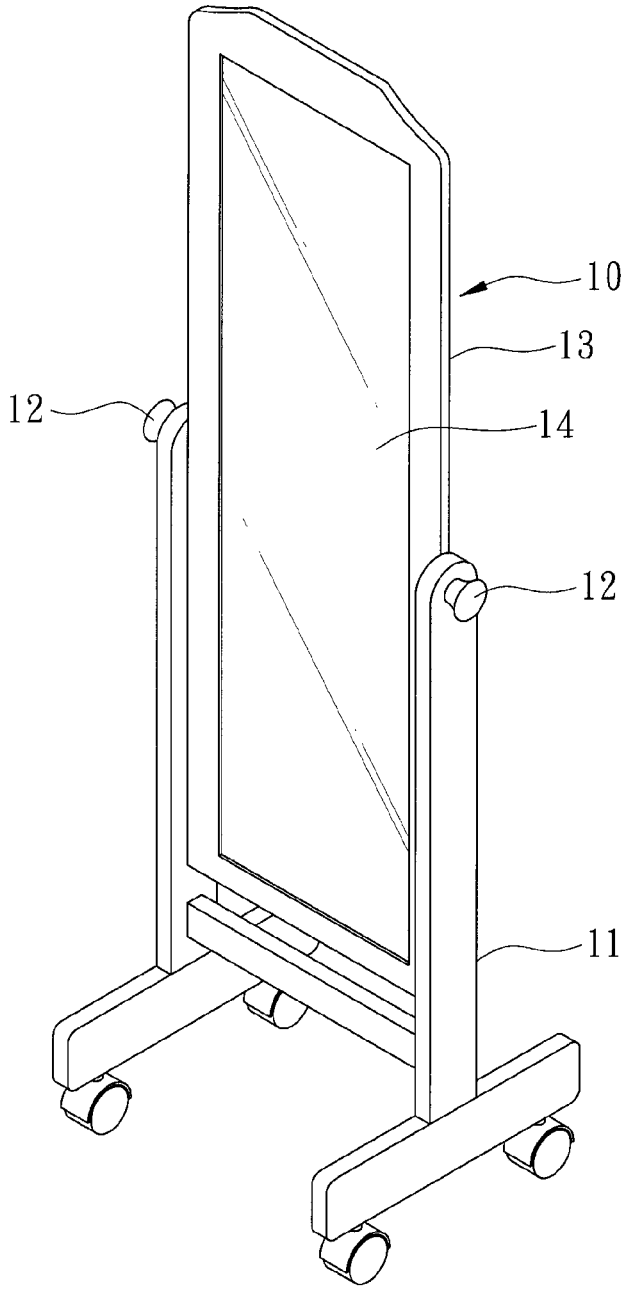
FIG. 1 PRIOR ART
FIG. 1 is a perspective view of a conventional adjustable dressing mirror assembly.
Figure 2:
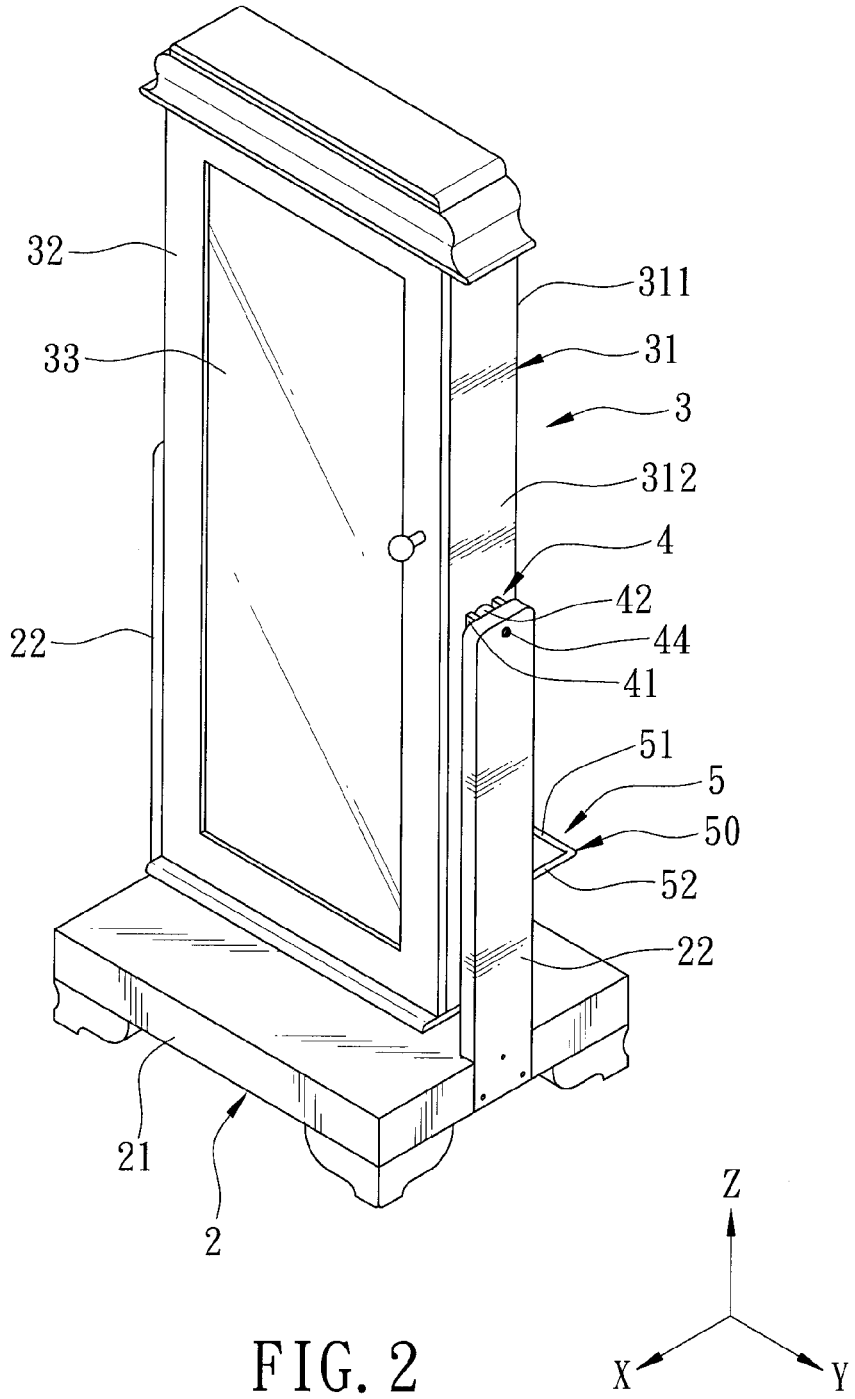
FIG. 2 is a perspective view of the preferred embodiment of an adjustable dressing mirror assembly according to this invention.
Figure 3:
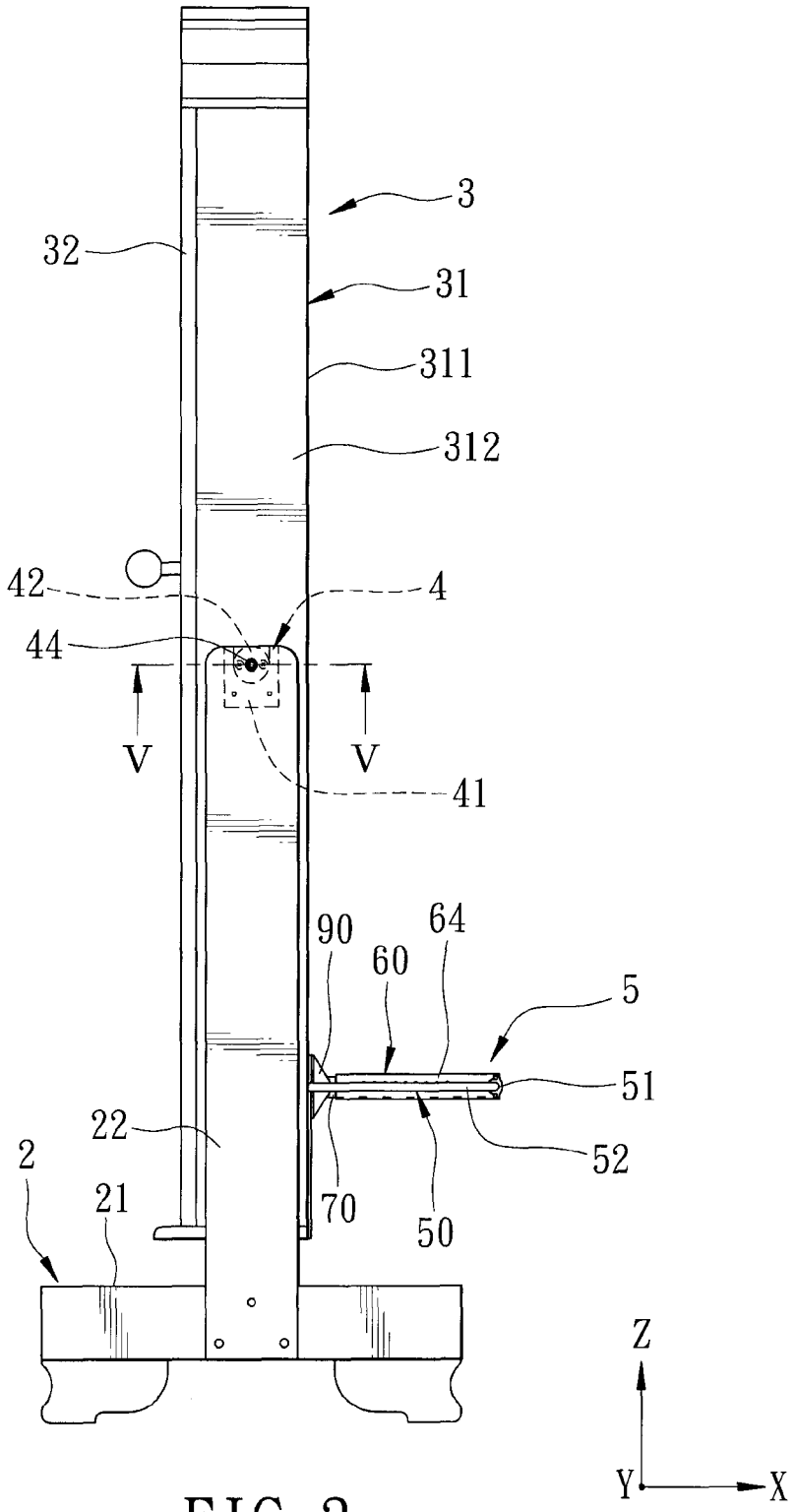
FIG. 3 is a left side view of the preferred embodiment, illustrating a vertical position of a mirror-mounting unit.

Referring to FIGS. 2 and 3, the preferred embodiment of an adjustable dressing mirror assembly according to this invention includes a support 2, a mirror-mounting unit 3, two pivotal connection units 4, and a positioning device 5.

The support 2 includes a base 21 and two upright rods 22 disposed fixedly on and above the base 21 and spaced apart from each other along a left-to-right direction (Y). Each of the upright rods 22 extends along a vertical direction (Z).

The mirror-mounting unit 3 includes a storage cabin housing 31, and a door plate 32 disposed openably on the storage cabin housing 31 and permitting a mirror 33 to be disposed fixedly thereon. The storage cabin housing 31 includes a rear plate 311 and two side plates 312 connected respectively and fixedly to two opposite sides of the rear plate 311.

Figure 4:
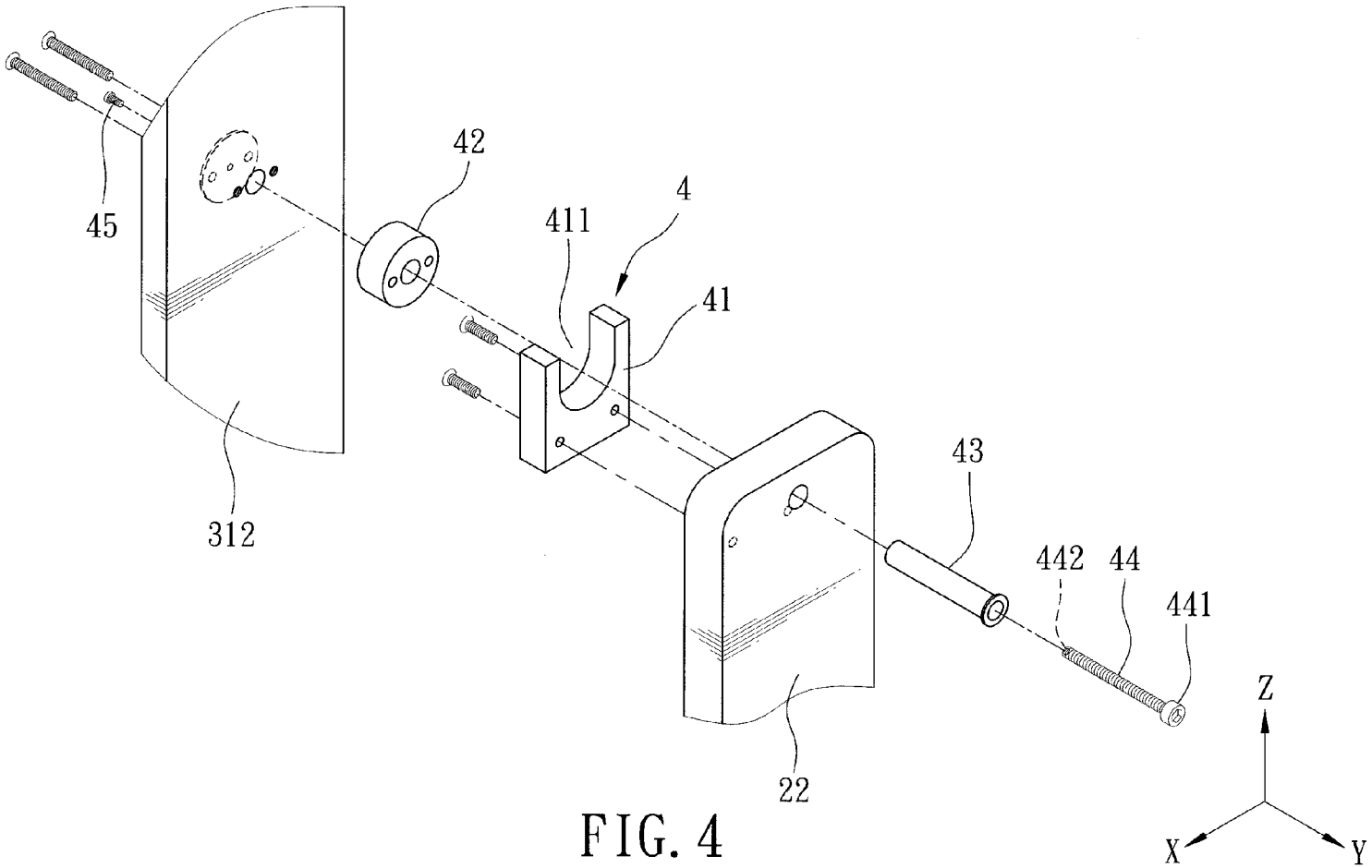
FIG. 4 is a fragmentary exploded perspective view of the preferred embodiment, illustrating a pivotal connection unit.
Figure 5:
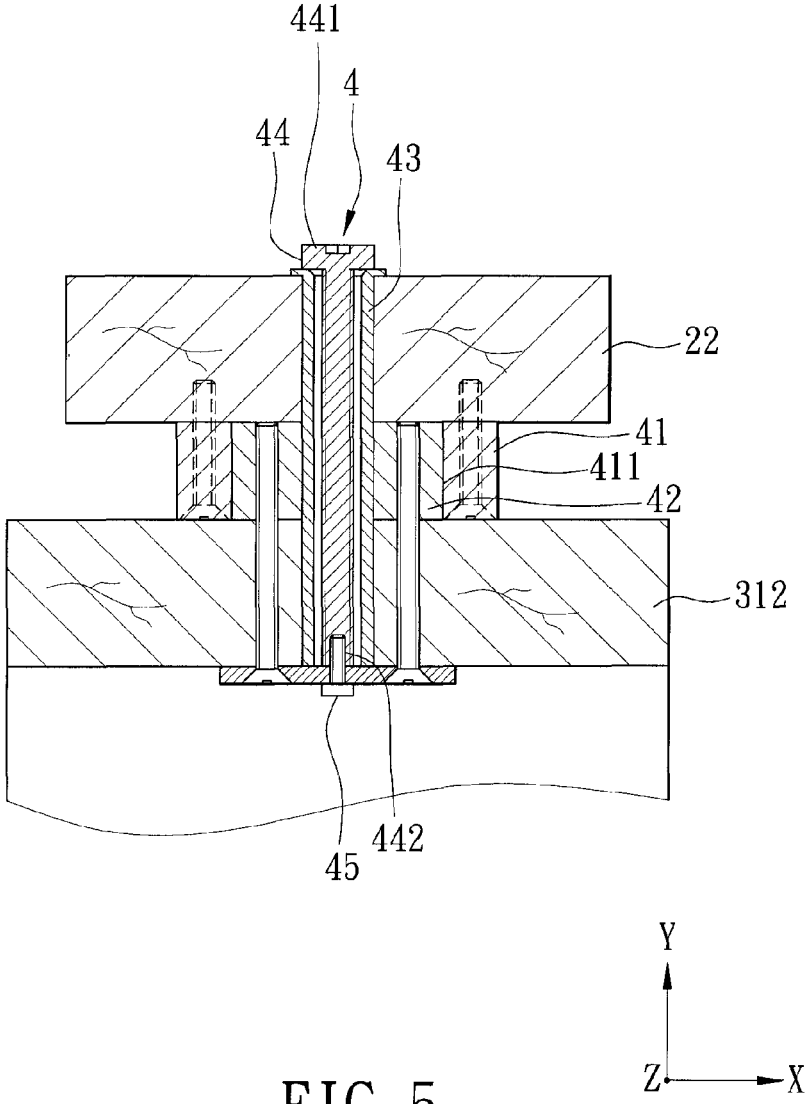
FIG. 5 is a sectional view taken along line V-V in FIG. 3.

With additional reference to FIGS. 4 and 5, each of the upright rods 22 is connected to an adjacent one of the side plates 312 by a respective one of the pivotal connection units 4. Each of the pivotal connection units 4 includes a bracket 41 disposed fixedly on the corresponding upright rod 22, a cylindrical rotating block 42 disposed fixedly on the corresponding side plate 312, a sleeve 43 extending through the corresponding upright rod 22 and the rotating block 42 and into the corresponding side plate 312 along the left-to-right direction (Y), a first bolt 44 extending into the sleeve 43 and having a head 441 at one end thereof and a threaded hole 442 formed in the other end thereof, and a second bolt 44 engaging the threaded hole 442 in the first bolt 44. The bracket 41 is formed with a curved groove 411. The cylindrical rotating block 42 is received rotatably within the curved groove 411 in the bracket 41.

As such, the mirror-mounting unit 3 is disposed rotatably between the upright rods 22 of the support 2 in such a manner to allow for forward and rearward pivoting movement of an upper end of the mirror-mounting unit 3 relative to the support 2.

Figure 6:
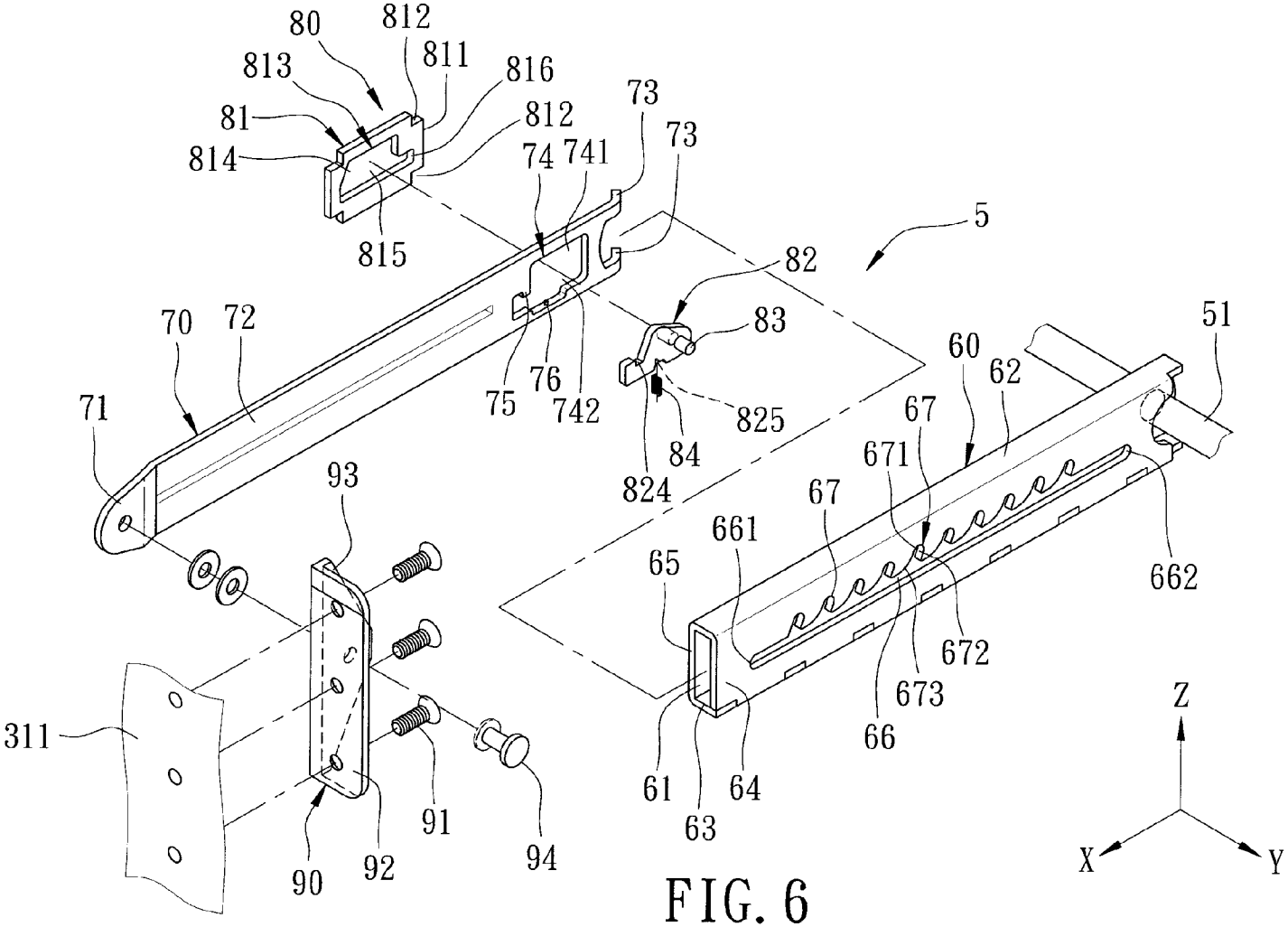
FIG. 6 is a fragmentary exploded perspective view of the preferred embodiment, illustrating a positioning device.
Figure 7:
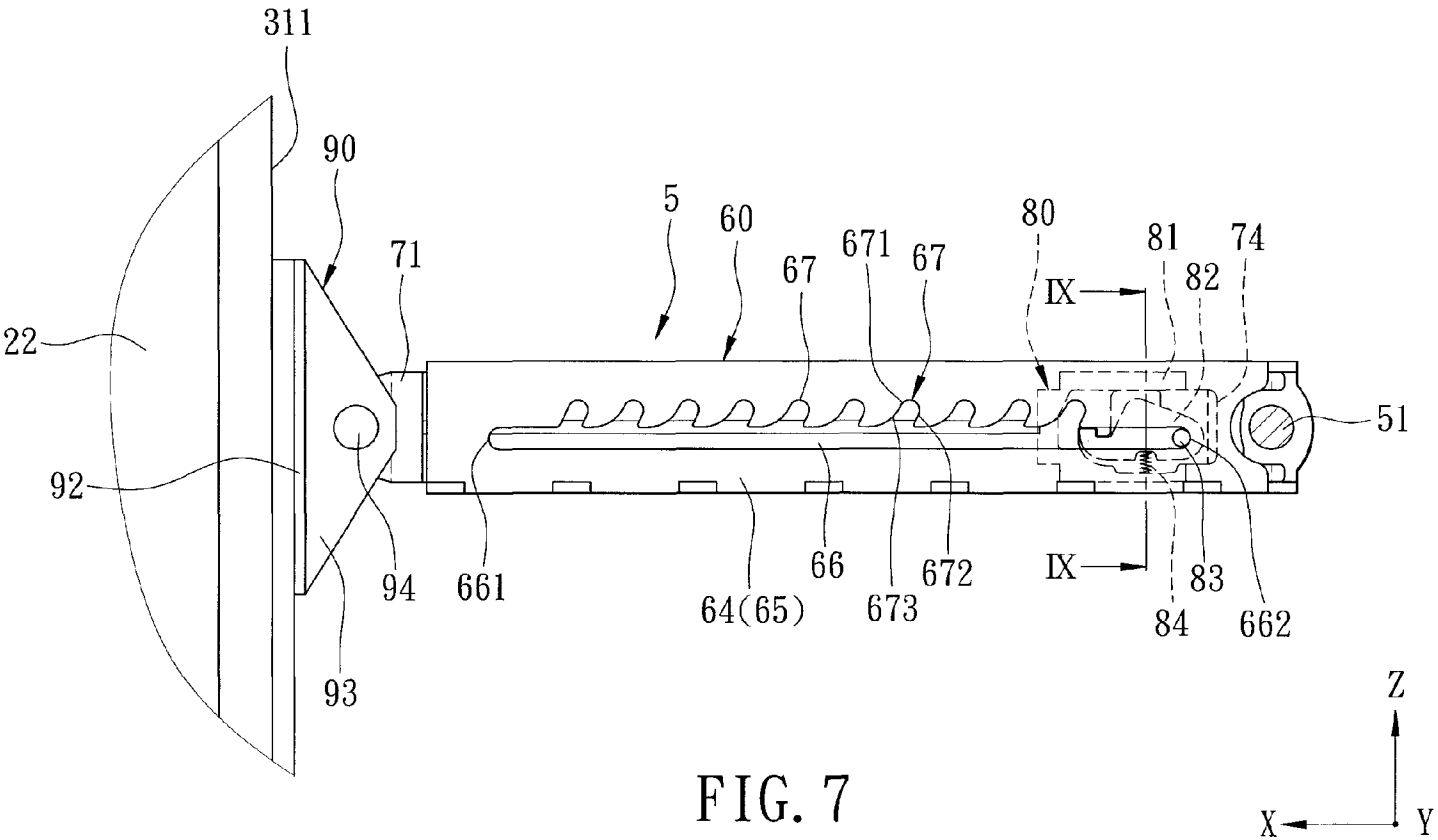
FIG. 7 is a fragmentary, partly sectional left side view of the preferred embodiment, an auxiliary rod of a fixed frame being removed for convenience of illustrating how the mirror-mounting unit is maintained at the vertical position by the positioning device.

With further reference to FIGS. 6 and 7, the positioning device 5 includes a fixed frame 50, a guiding seat 60, a driving plate 70, a positioning unit 80, and a connecting seat 90.

Figure 8:
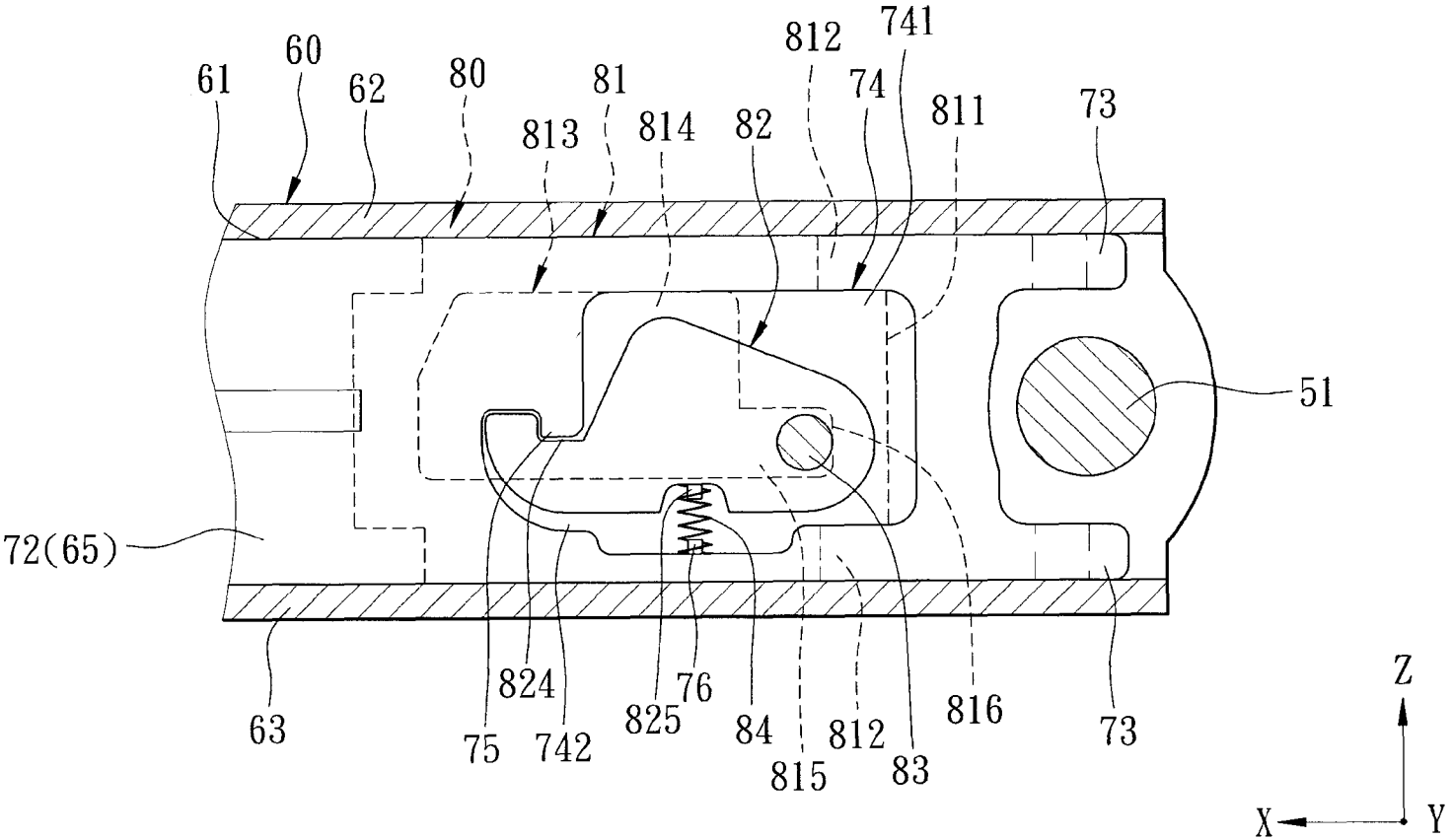
FIG. 8 is a fragmentary sectional view of the preferred embodiment, illustrating relative positions among a driving plate, a movable member, a positioning rod, and a sliding block when the mirror-mounting unit is at the vertical position.
Figure 9:
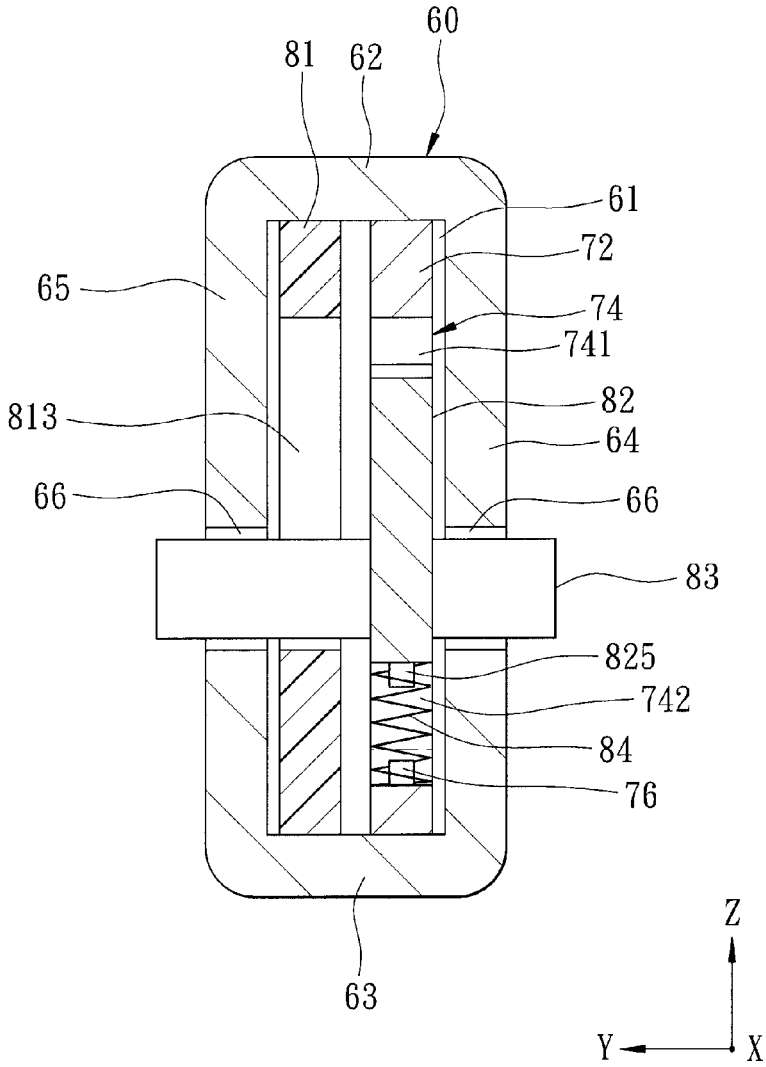
FIG. 9 is a sectional view taken along line IX-IX in FIG. 7.

With further reference to FIGS. 8 and 9, the fixed frame 50 is generally U-shaped, and includes a main rod 51 extending along the left-to-right direction (Y), and two auxiliary rods 52 extending respectively and perpendicularly from two opposite ends of the main rod 51 along a front-to-rear direction (X).

The guiding seat 60 includes a top plate 62, a bottom plate 63, a left side plate 64, and a right side plate 65, and defines an accommodating chamber 61 among the top, bottom, left side, and right side plates 62, 63, 64, 65. Each of the left and right side plates 64, 65 has a guide slot 66 extending along the front-to-rear direction (X), and a plurality of positioning grooves 67 arranged along the front-to-rear direction (X) and disposed above and in spatial communication with the guide slot 66.

The guiding seat 60 has a rear end that is connected pivotally to the main rod 51.

The guide slot 66 of each of the left and right side plates 64, 65 has a closed front end 661 and a closed rear end 662.

Each of the positioning grooves 67 is defined by a curved top surface 671, an inclined rear stop surface 672 extending forwardly and downwardly from a rear end of the curved top surface 671, and an inclined front guiding surface 673 extending forwardly and downwardly from a front end of the curved top surface 671.

The driving plate 70 is movable forwardly and rearwardly within the accommodating chamber 61 between front and rear limit positions, and includes a front end pivot portion 71, a plate body 72 extending rearwardly from the front end pivot portion 71, two driving arms 73 arranged one above the other and extending rightwardly from a rear end of the plate body 72, an accommodating hole 74 formed through the plate body 72 and adjacent to the driving arms 73, a stop projection 75 extending downwardly from the plate body 72 into the accommodating hole 74, and a first insert post 76 extending upwardly from the plate body 72 into the accommodating hole 74.

The accommodating hole 74 has a first short top section 741 and a first long bottom section 742.

The stop projection 75 extends into the first long bottom section 742.

The first insert post 76 is disposed behind the stop projection 75.

The positioning unit 80 includes a sliding block 81 disposed movably within the accommodating chamber 61 in the guiding seat 60 and between the right side plate 65 and the plate body 72 of the driving plate 70, a movable member 82 disposed movably within the accommodating hole 74 in the driving plate 70, a positioning rod 83 disposed fixedly on the movable member 82 and extending along the left-to-right direction (Y), and a resilient member 84 disposed between the movable member 82 and the driving plate 70.

The sliding block 81 has two notches 812 formed in a rear end thereof and aligned respectively with the driving arms 73 of the driving plate 70, and an L-shaped through hole 813 formed therethrough along the left-to-right direction (Y). The through hole 813 is generally L-shaped, and has a second short top section 814 and a second long bottom section 815 that has a rear end 816 disposed behind the second short top section 814.

The movable member 82 includes a recess 824 and a second insert post 825 extending downwardly therefrom and disposed behind the recess 824.

The positioning rod 83 extends through and is connected fixedly to the movable member 82 at a position behind the second insert post 825, and extends movably into the guide slots 66 and the through hole 813.

In this embodiment, the resilient member 84 is a coiled compression spring, and has a lower end sleeved on the first insert post 76, and a top end sleeved on the second insert post 825 for biasing the positioning rod 83 to move upwardly toward the positioning grooves 67.

The connecting seat 90 includes a lock plate 92 secured to the rear plate 311 by bolts 91, and a pivotal connection plate 93 extending integrally and perpendicularly from a right side of the lock plate 92 along the front-to-rear direction (X) and connected pivotally to the front end pivot portion 71 of the driving plate 70 by a pivot member 94.

During use, with particular reference to FIGS. 3, 6, 7, 8, and 9, when the mirror-mounting unit 3 is in a vertical position, the whole plate body 72 of the driving plate 70 is disposed within the accommodating chamber 61, and the positioning rod 83 is disposed at the rear ends 662 of the guide slots 66, and the rear end 816 of the long bottom section 815 of the through hole 813. Also in the vertical position, the driving arms 73 are spaced apart from the sliding block 81 by a predetermined distance, and the resilient member 84 is compressed to store a return force.

Figure 10:
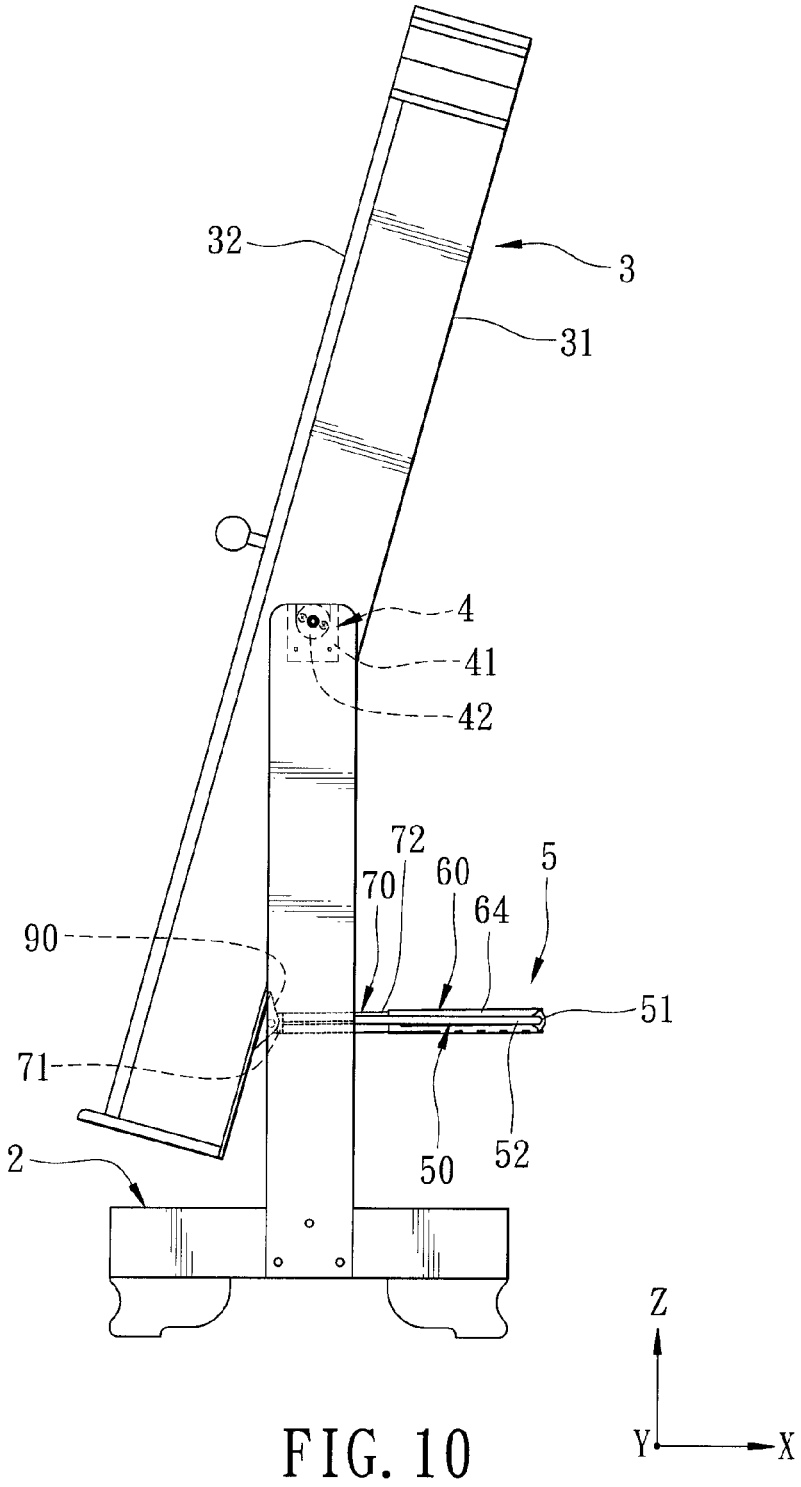
FIG. 10 is a view similar to FIG. 3 but illustrating an inclined position of the mirror-mounting unit.
Figure 11:
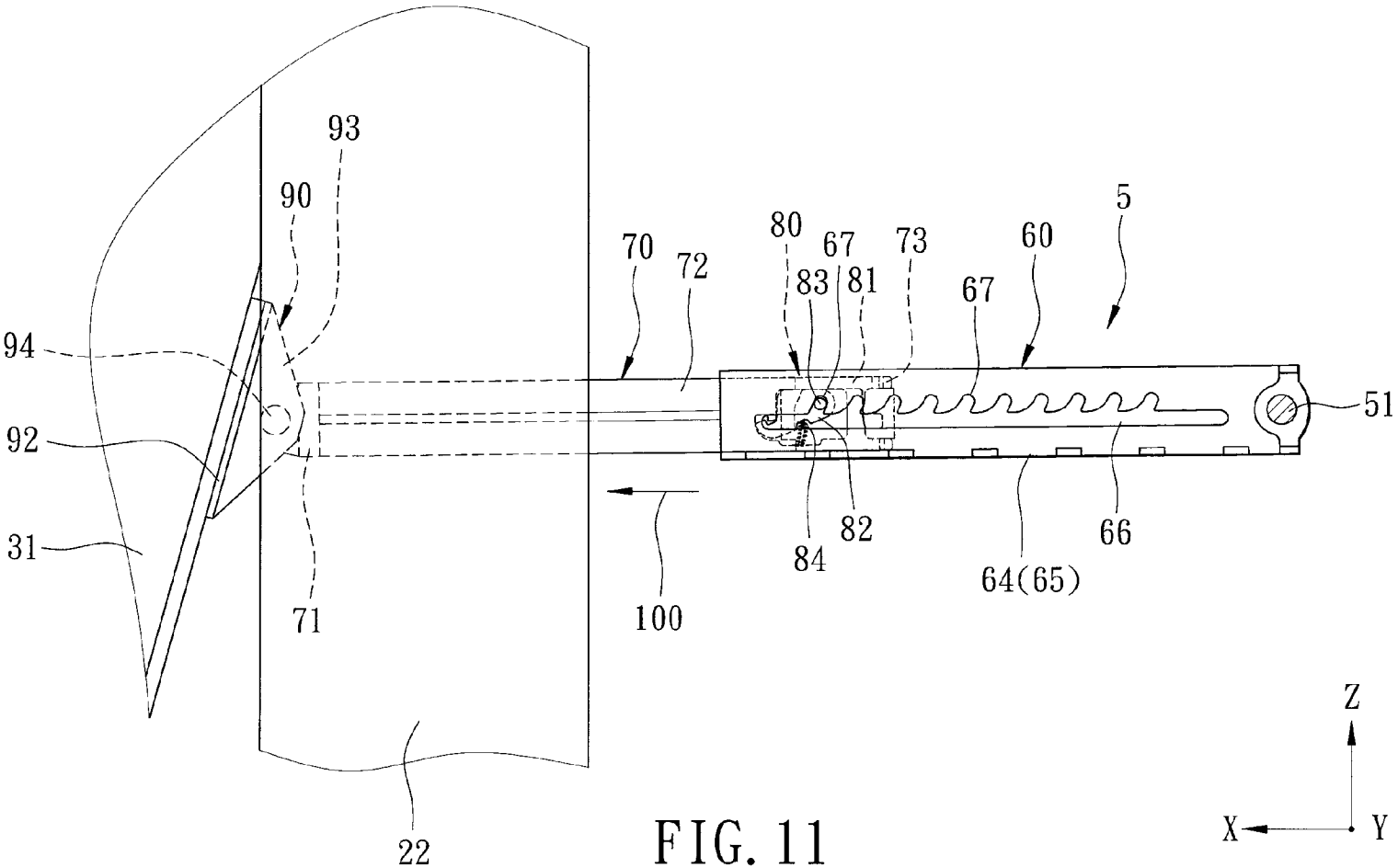
FIG. 11 is a fragmentary, partly sectional left side view of the preferred embodiment, the auxiliary rod of the fixed frame being removed for convenience of illustrating that the mirror-mounting unit is maintained at the inclined position by the positioning device.
Figure 12:
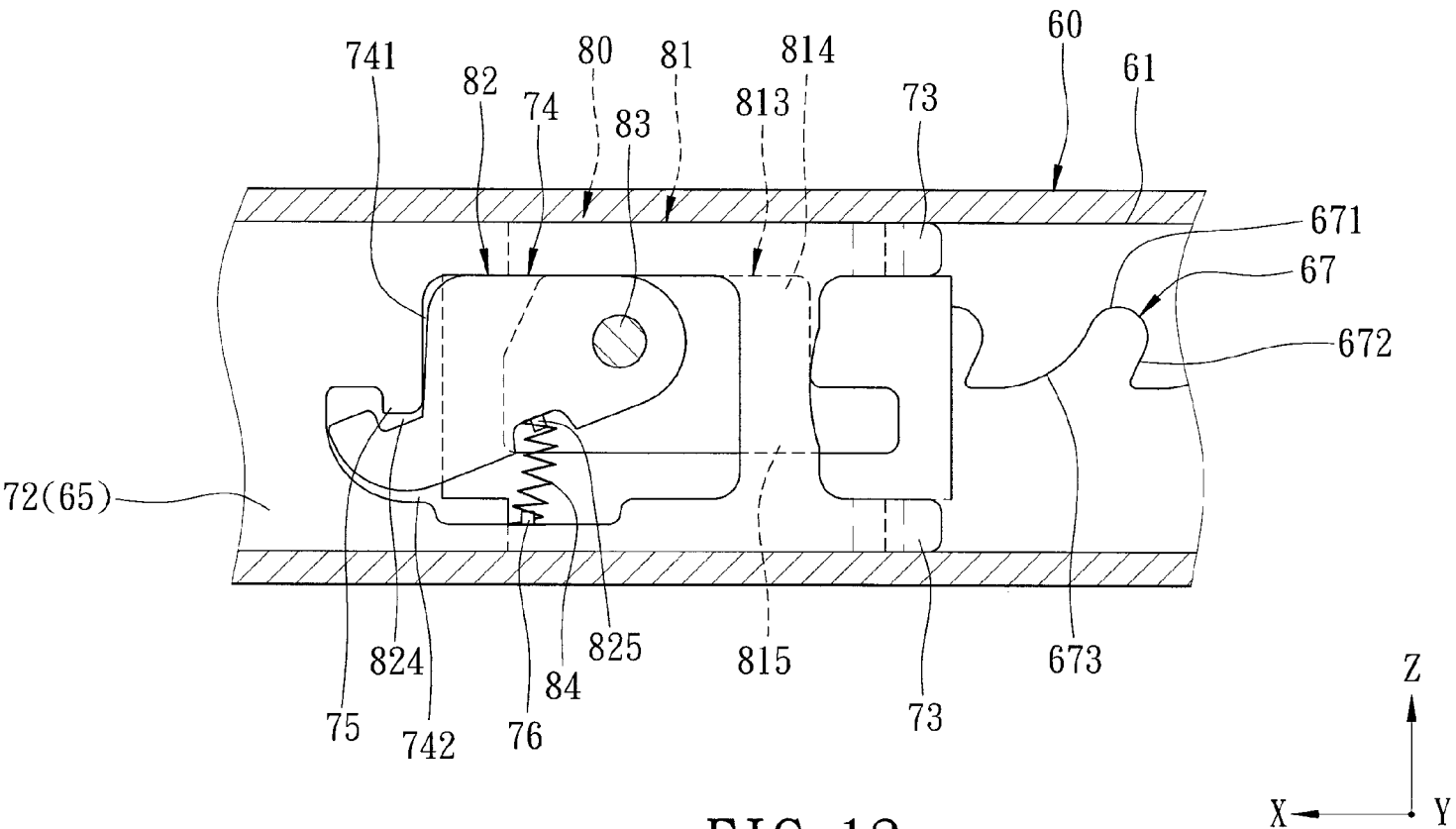
FIG. 12 is a fragmentary sectional view of the preferred embodiment, illustrating relative positions among the driving plate, the movable member, the positioning rod, and the sliding block when the mirror-mounting unit is at the inclined position.
Figure 13:
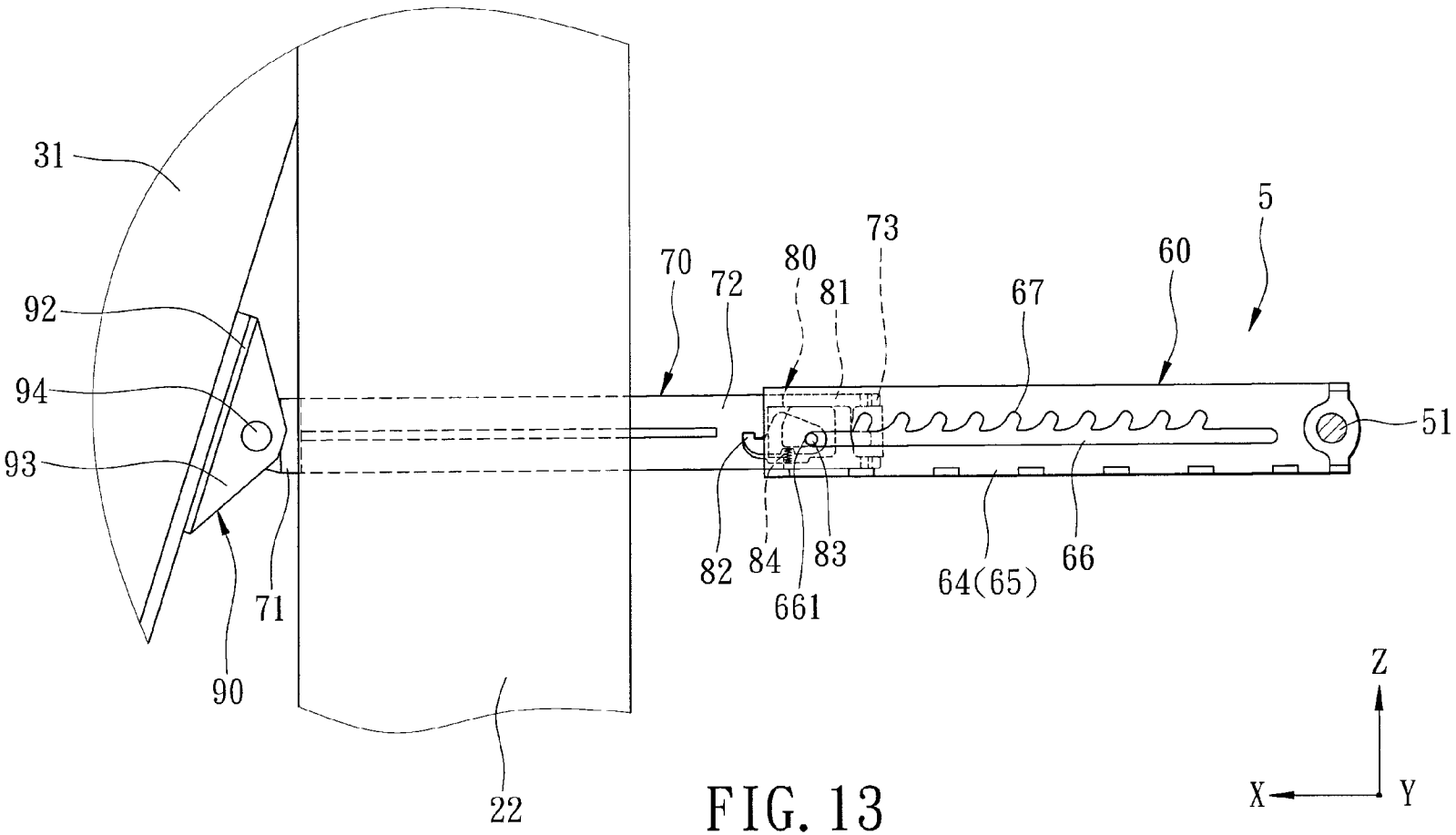
FIG. 13 is a view similar to FIG. 11 but illustrating a front limit position of the driving plate.
Figure 14:
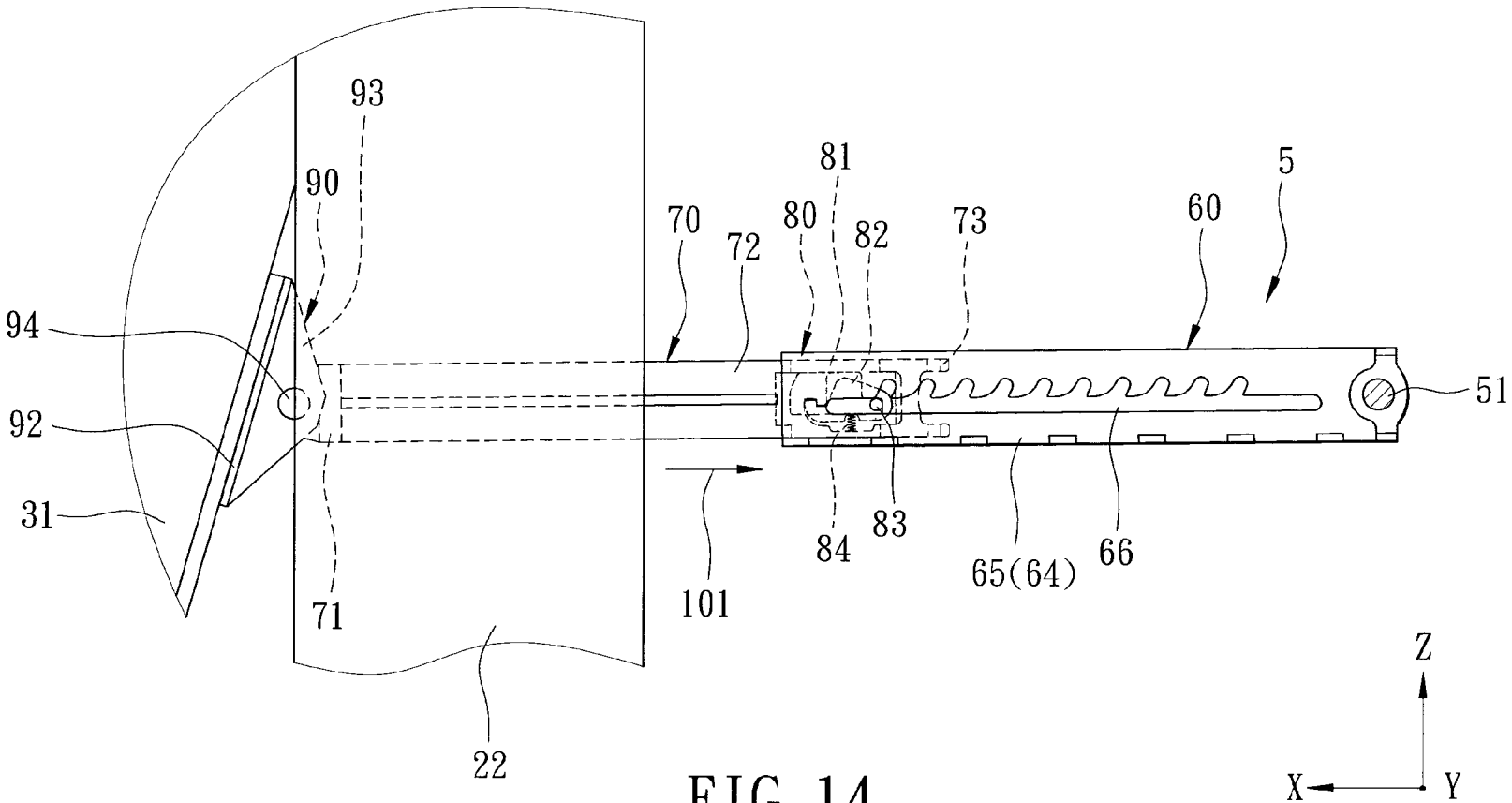
FIG. 14 is a view similar to FIG. 13 but illustrating how engagement of the positioning rod and a plurality of positioning grooves is prevented during rearward movement of the driving plate from the front limit position.
Figure 15:
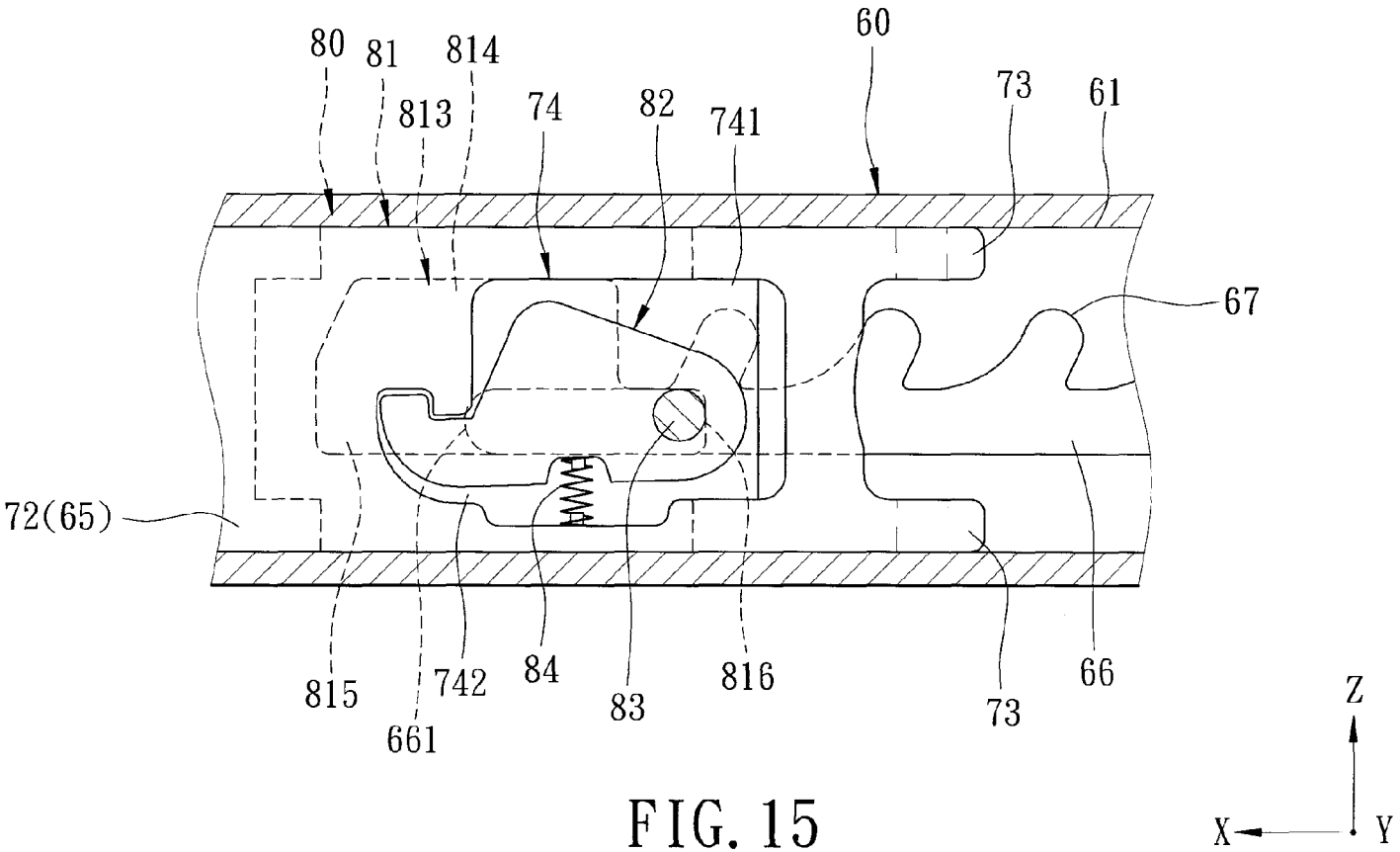
FIG. 15 is a view similar to FIG. 12 but illustrating how engagement of the positioning rod and the positioning grooves is prevented during rearward movement of the driving plate from the front limit position.

When adjustment of the mirror-mounting unit 3 is desired, a pushing force is applied to push an upper end of the mirror-mounting 3 rearwardly to pivot the mirror-mounting unit 3 to an inclined position, e.g., shown in FIG. 10. With particular reference to FIGS. 6, 10, 11, and 12, upon application of the pushing force to the upper end of the mirror-mounting unit 3, the driving plate 70 is moved forwardly relative to the guiding seat 60 in a direction 100 (see FIG. 11). At the same time, the movable member 82 and the positioning rod 83 are driven by the driving plate 70 to move forwardly within the accommodating chamber 61. During forward movement of the driving plate 70, the positioning rod 8 moves from the rear end 816 of the second long bottom section 815 of the through hole 813 into the second short top section 814, and subsequently the driving arms 73 come into contact with the sliding block 81 in such a manner to engage the notches 811, respectively. Hence, the sliding block 81 is pushed by the driving arms 73 forwardly to co-move with the driving plate 70. When the pushing force is released, the positioning rod 83 is biased by the resilient member 84 to engage two of the positioning grooves 67 corresponding to the inclined position, thereby maintaining the mirror-mounting unit 3 at the inclined position. At this time, since each of the positioning grooves 67 is inclined upwardly and rearwardly, rearward pivoting movement of the upper end of the mirror-mounting unit 3 is allowed, while forward pivoting movement of the upper end of the mirror-mounting unit 3 is prevented.

When it is desired to return the mirror-mounting unit 3 to the vertical position, the upper end of the mirror-mounting unit 3 is continued to be pushed rearwardly until the positioning rod 83 is moved into the front ends 661 of the guide slots 66 and the front end of the first long bottom section 742 of the accommodating hole 74. Subsequently, the mirror-mounting unit 3 is pivoted back to the vertical position to thereby push and move the driving plate 70 rearwardly relative to the guiding seat 6 until the positioning rod 83 reaches the rear ends 662 of the guide slots 66. During rearward movement of the driving plate 70 from the front ends 661 of the guide slots 66, since the positioning rod 83 pushes a wall of the sliding block 81 defining the rear end 816 of the second long bottom section 815 of the through hole 813 to move rearwardly, it is disposed in the second long bottom section 815, thereby preventing the positioning rod 83 from being biased by the resilient member 84 to move into any of the positioning grooves 67. That is, during movement of the driving plate 70 from the front limit position to the rear limit position, engagement between the positioning rod 83 and the positioning grooves 67 is prevented.

In view of the above, the adjustable dressing mirror assembly of this invention has the following advantages:

1. When the mirror-mounting unit 3 is adjusted to a desired angle, through engagement between the positioning rod 83 and the positioning grooves 67, the mirror-mounting unit 3 can be maintained at the desired angle.
2. Since it is not necessary to operate the driving plate 70 with hand, safety during use of the positioning device 5 is promoted.

With this invention thus explained, it is apparent that numerous modifications and variations can be made without departing from the scope and spirit of this invention. It is therefore intended that this invention be limited only as indicated by the appended claims.

I claim:

1. An adjustable dressing mirror assembly comprising:
a support including two upright rods;
a mirror-mounting unit disposed rotatably between said upright rods of said support in such a manner to allow for forward and rearward pivoting movement of an upper end of said mirror-mounting unit relative to said support;
a mirror disposed on said mirror-mounting unit; and
a positioning device including
a fixed frame disposed fixedly between said upright rods of said support,
an elongated guiding seat including a rear end connected pivotally to said fixed frame, opposite top and bottom plates, and opposite left and right side plates cooperating with said top and bottom plates to define an accommodating chamber, each of said left and right side plates having a guide slot extending along a front-to-rear direction, and a plurality of positioning holes arranged along the front-to-rear direction and in spatial communication with said guide slot,
a driving plate movable forwardly and rearwardly within said accommodating chamber between front and rear limit positions and including a front end connected pivotally to said mirror-mounting unit, and an accommodating hole having a first short top section and a first long bottom section, each of said first short top section and said first long bottom section extending along the front-to-rear direction and being in spatial communication with the other one of said first short top section and said first long bottom section,
a sliding block disposed movably within said accommodating chamber in said guiding seat and co-movable with said driving plate upon forward movement of said driving plate within said accommodating chamber to a predetermined position, said sliding block including a through hole having a second short top section and a second long bottom section, each of said second short top section and said second long bottom section extending along the front-to-rear direction and being in spatial communication with the other one of said second short top section and said second long bottom section,
a movable member disposed movably within said accommodating hole in said driving plate,
a positioning rod disposed fixedly on said movable member and extending along a left-to-right direction, and
a resilient member disposed between said movable member and said driving plate for biasing said positioning rod toward said positioning grooves in said left and right side plates of said guiding seat;
wherein said accommodating hole in said driving plate and said through hole in said sliding block are positioned such that, engagement between said positioning rod and said positioning grooves in each of said left and right side plates of said guiding seat is allowed when said positioning rod is disposed within said first and second short top sections of said accommodating hole and said through hole during movement of said driving plate within said accommodating chamber from the rear limit position to the front limit position, and is prevented when said positioning rod is disposed within said first and second long bottom sections of said accommodating hole and said through hole during movement of said driving plate within said accommodating chamber from the front limit position to the rear limit position.

2. The adjustable dressing mirror assembly as claimed in claim 1, wherein each of said positioning grooves in each of said left and right side plates of said guiding seat is defined by a curved top surface, an inclined rear stop surface extending forwardly and downwardly from a rear end of said curved top surface into said guide slot in a corresponding one of said left and right side plates, and an inclined front guiding surface extending forwardly and downwardly from a front end of said curved top surface into said guide slot in the corresponding one of said left and right side plates.

3. The adjustable dressing mirror assembly as claimed in claim 2, wherein said driving plate further includes a plate body formed with said accommodating hole, and a first insert post extending from said plate body into said accommodating hole, and said movable member further includes a second insert post aligned with said first insert post, said resilient member being configured as a coiled compression spring having a bottom end sleeved on said first insert post, and a top end sleeved on said second insert post.

4. The adjustable dressing mirror assembly as claimed in claim 3, wherein:
said positioning rod is connected fixedly to said movable member at a position behind said second insert post;
said movable member further includes a recess formed in a portion of said movable member disposed in front of said second insert post; and
said driving plate further includes a stop projection extending downwardly from said plate body into said recess in said movable member, so that said positioning rod is biased by said resilient member to move upwardly within said accommodating hole in said driving plate.

5. The adjustable dressing mirror assembly as claimed in claim 4, wherein said sliding block further includes two notches formed in a rear end thereof and arranged one above the other, and said driving plate further includes two driving arms bent laterally from a rear end of said plate body and disposed behind and aligned respectively with said notches in said sliding block, said driving arms being movable forwardly into contact with said sliding block in such a manner to engage said notches, so that said driving plate is moved to said predetermined position for pushing said sliding block forwardly within said accommodating chamber in said guiding seat.

6. The adjustable dressing mirror assembly as claimed in claim 1, wherein said mirror-mounting unit includes a storage cabin housing and a door plate disposed openably on said storage cabin housing, said mirror being disposed fixedly on said door plate, said storage cabin housing including a rear plate and two side plates, said adjustable dressing mirror assembly further comprising two pivotal connection units, each of said pivotal connection units being connected between a respective one of said side plates and a respective one of said upright rods, and including a bracket disposed fixedly on a corresponding one of said upright rods, a rotating block disposed fixedly on a corresponding one of said side plates, a sleeve extending through the corresponding one of said upright rod and said rotating block and into the corresponding one of said side plates such that said bracket is disposed between the corresponding one of said upright rods and the corresponding one of said side plates, a first bolt extending into said sleeve and having a head disposed at one end thereof and a threaded hole formed in the other end thereof, and a second bolt extending into said sleeve to engage said threaded hole in said first bolt for retaining said rotating block on said bracket, in such a manner to allow for rotation of said rotating block relative to said bracket.

* * * * *